US006510569B1

(12) United States Patent
Hu

(10) Patent No.: US 6,510,569 B1
(45) Date of Patent: Jan. 28, 2003

(54) DOUBLE LOCKS FOR THE CHASSIS OF GAME-BED

(76) Inventor: Stephen Hu, No 2, Ta-Tung Road, Hsin-Chu Industrial Park (TW)

( * ) Notice: Subject to any disclaimer, the term of this patent is extended or adjusted under 35 U.S.C. 154(b) by 37 days.

(21) Appl. No.: 09/717,468

(22) Filed: Nov. 20, 2000

(51) Int. Cl.[7] ..... F16C 11/10
(52) U.S. Cl. ..... 5/99.1; 5/98.2; 5/93.1
(58) Field of Search ..... 5/99.1, 98.1, 93.1, 5/98.2

(56) References Cited

U.S. PATENT DOCUMENTS 5,279,006 A * 1/1994 Teng ..... 5/98.1
5,358,220 A * 10/1994 Yu-Kuang ..... 256/24
5,819,342 A * 10/1998 Williams ..... 248/167
5,890,263 A * 4/1999 Wu ..... 16/324
6,256,814 B1 * 7/2001 Drobinski ..... 248/169
6,295,667 B1 * 10/2001 Cheng ..... 5/99.1
6,336,234 B1 * 1/2002 Kuo ..... 5/93.1

* cited by examiner

*Primary Examiner*—Lynne H. Browne
*Assistant Examiner*—Frederick Conley
(74) *Attorney, Agent, or Firm*—Pro-Techtor International Services

(57) ABSTRACT

The present invention "Double locks for the chassis of game-bed" includes two locks on the center of the chassis of game-bed. The edges of double locks are connected to the vertical stands of game-bed via several pillars. When the bars inside the second cylinders stretch out, the chassis is locked. So, the game-bed cannot be folded if kids carelessly try to fold it; and thus the kids are safe. When users pull the handle of double locks, the bar will be forced to contract. Then, user may fold the game-bed for storage, thereby save space. The present invention promotes safety for the game-bed, is easy to use, and is a highly practical device.

6 Claims, 5 Drawing Sheets

DOUBLE LOCKS FOR THE CHASSIS OF GAME-BED

BACKGROUND OF THE INVENTION

1. Field of the Invention

The present invention relates to a security device named double locks for the chassis of game-bed. After the device is installed in the game-bed, users need to pull the handle of device before they can fold the game-bed. The present invention is designed to promote safety, and prevent accidents from happening.

2. Description of the Prior Art

The present invention relates to a security device named double locks for the chassis of game-bed. The device includes, to the minimum extent, a handle and a flexible bar inside the second cylinder. The bar pushes up to lock the chassis. To fold the game-bed, users pull the handle to recoil the bar in order to unlock the device. When the double locks are installed in the game-bed, users are safer, and the probability of accidents is reduced.

SUMMARY OF THE INVENTION

When unfolded, the kid's game-bed occupies a large space. When users don't use the game-bed, they fold it for storage so as to save space. Users simply push the stands under chassis to fold the game-bed. It's that simple. Because it's so simple, it can be dangerous to the kids. When kids fold the game-bed by themselves, their fingers might be jammed. To alleviate the security concern and promote safety, the inventor has studied the structure of game-bed thoroughly, and then introduced the present invention for users' safety.

The present invention will be apparent in its contents of technique after reading the detailed description of the preferred embodiments of the present invention in reference to the accompanying drawings, wherein:

DETAILED DESCRIPTION OF THE PREFERRED EMBODIMENT

Figure 1:
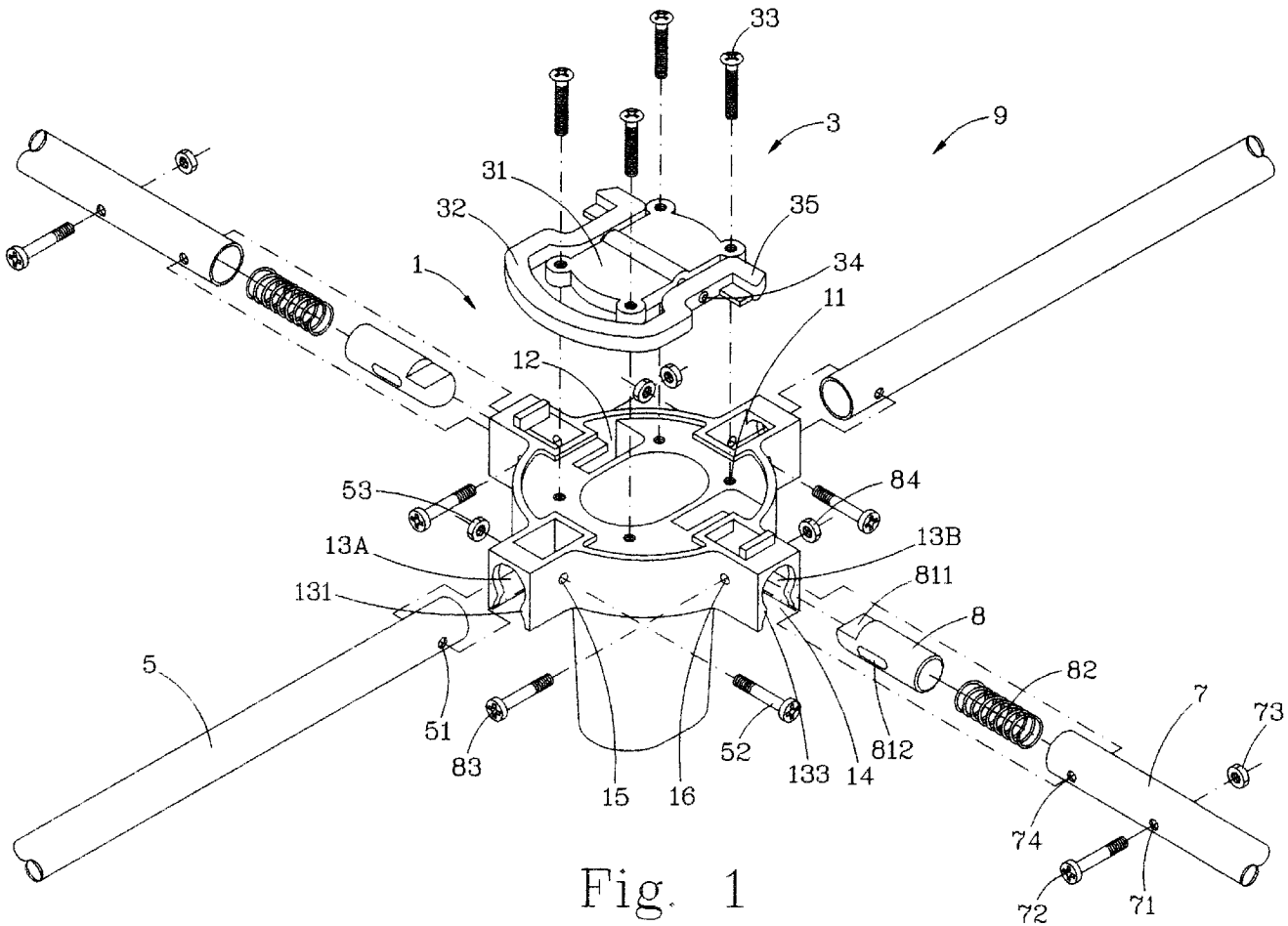
FIG. 1 is a stereoscopic assembly drawing of present invention.
Figure 2:
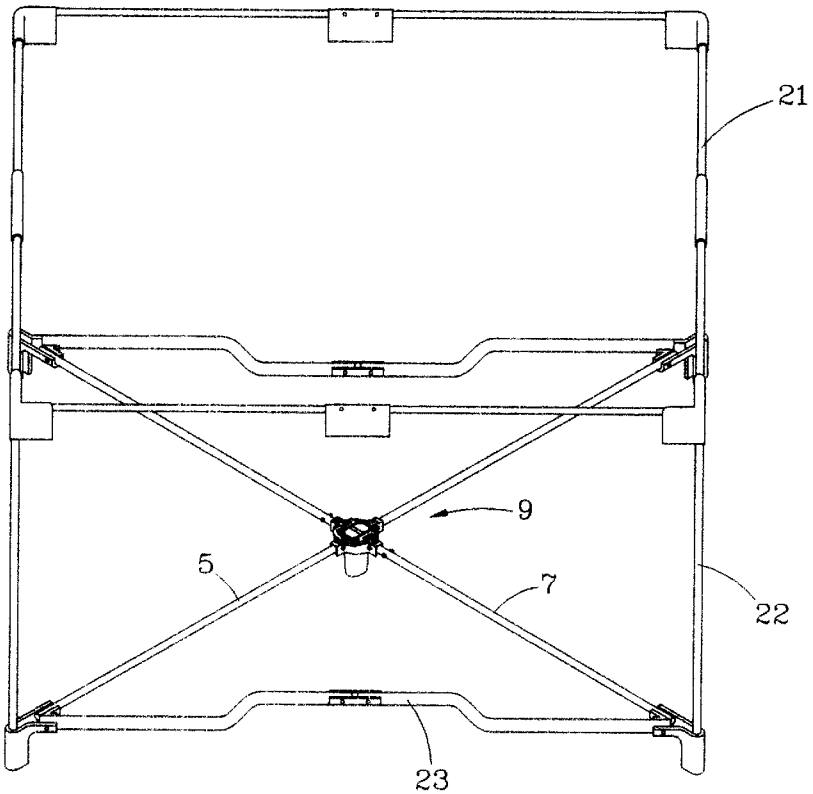
FIG. 2 is a perspective view showing the appearance of present invention.

As shown in FIG. one and FIG. two, the game-bed includes, to the minimum extent, several upper stands 21, vertical stands 22, and side stands 23. The double locks 9 on the bottom center of game-bed are essential for present invention. The present invention also includes, to the minimum extent, main unit 1, releasing device 3, two pieces of first cylinder 5, two pieces of second cylinders 7, and two corresponding bars 8. The structure of present invention is described as follows:

There is a main unit 1 with a releasing device 3 on its top. First cylinder 5,5 and second cylinder 7,7 surround main unit 1. On the top of main unit 1 are several keyholes 11 that hold screws 33 to lock the releasing device 3. There are also two concave chutes 12,12 in the proper positions on the top. In addition, there are four pieces of tube-chutes 13A, 13A, 13B, 13B with open-base on the edge of main unit 1. The tube-chutes 13A that face each other connect the first cylinder 5,5. There is a hole 15 passing through tube-chute 13A horizontally. There is another hole 51 passing through the first cylinder 5 that allows screw 52 to pass through both hole 15 and hole 51 to lock the cap 53. So, the first cylinder 5 can sway around with screw 52 serving as its axis. To fix first cylinder 5 in its position after it is set in tube-chute 13A, a blocking object 131 on the bottom of tube-chute 13A restricts the first cylinder 5 in the tube-chute 13A. Other two tube-chutes 13B are similar to tube-chutes 13A in regard to structure. Tube-chutes 13B connect to second cylinder 7, and have blocking objects 133. There is a hole 16 on the tube-chute 13B horizontally. There is another hole 74 on second cylinder 7. The screw 83 passes through hole 16 and hole 74 to lock the cap 84. So, the second cylinder 7 can sway around with screw 83 serving as its axis.

The releasing device 3 consists of a base 31, ring 32, and axis 34. The axis 34 passes through the base 31 and ring 32. That's how the ring is fixed in the base 31, and is free to move around. On the end of handle 32 are two pieces of swaying objects 35. The swaying objects 35 are located right above the concave chute 12 of the main unit 1.

There is a hole 71 on the second cylinder 7. Screw 72 passes through the hole 71 to lock the cap 73. Inside the second cylinder 7 is a spring 82. The spring 82 is located between a bar 8 and screw 72. There is an opening 812 on the bar 8. Screw 83 passes through it, and locks at the end of second cylinder 7. With the spring 82 inside the bar 8, the bar 8 stretches out under normal condition. In addition, there is a flat area 811 on the external edge of bar 8.

Figure 3:
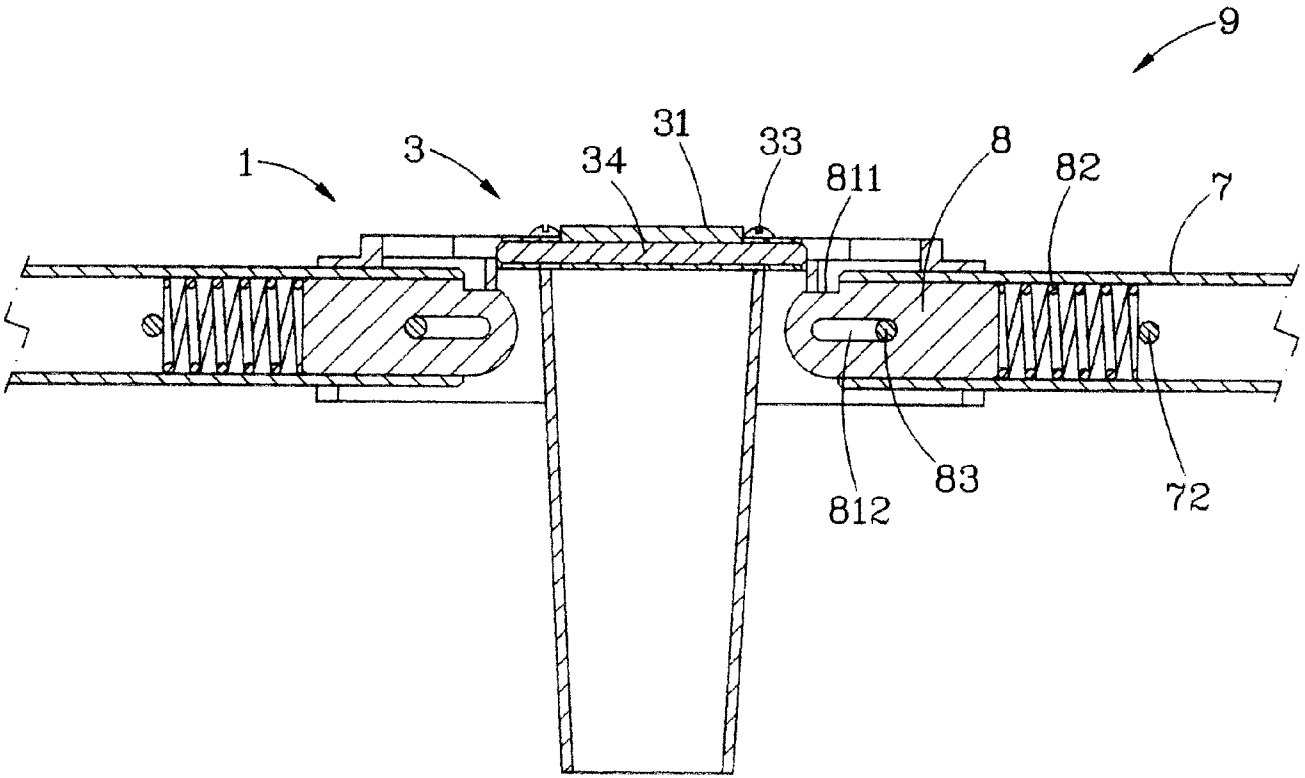
FIG. 3 is a sectional structural drawing of present invention.

As shown by FIG. 3, when the game-bed is unfolded, which means that both first cylinder 5,5 and second cylinder 7,7 are placed flatly, first cylinder 5,5 and second cylinder 7,7 are inserted into their corresponding tube-chutes 13A, 13A, and 13B, 13B. At this time, the bar 8,8 of second cylinder 7,7 stretches outward to lock second cylinder 7,7 and main unit 1 together. As the second cylinder 7,7 cannot sway downward and cannot be folded, users are safe.

Figure 4:
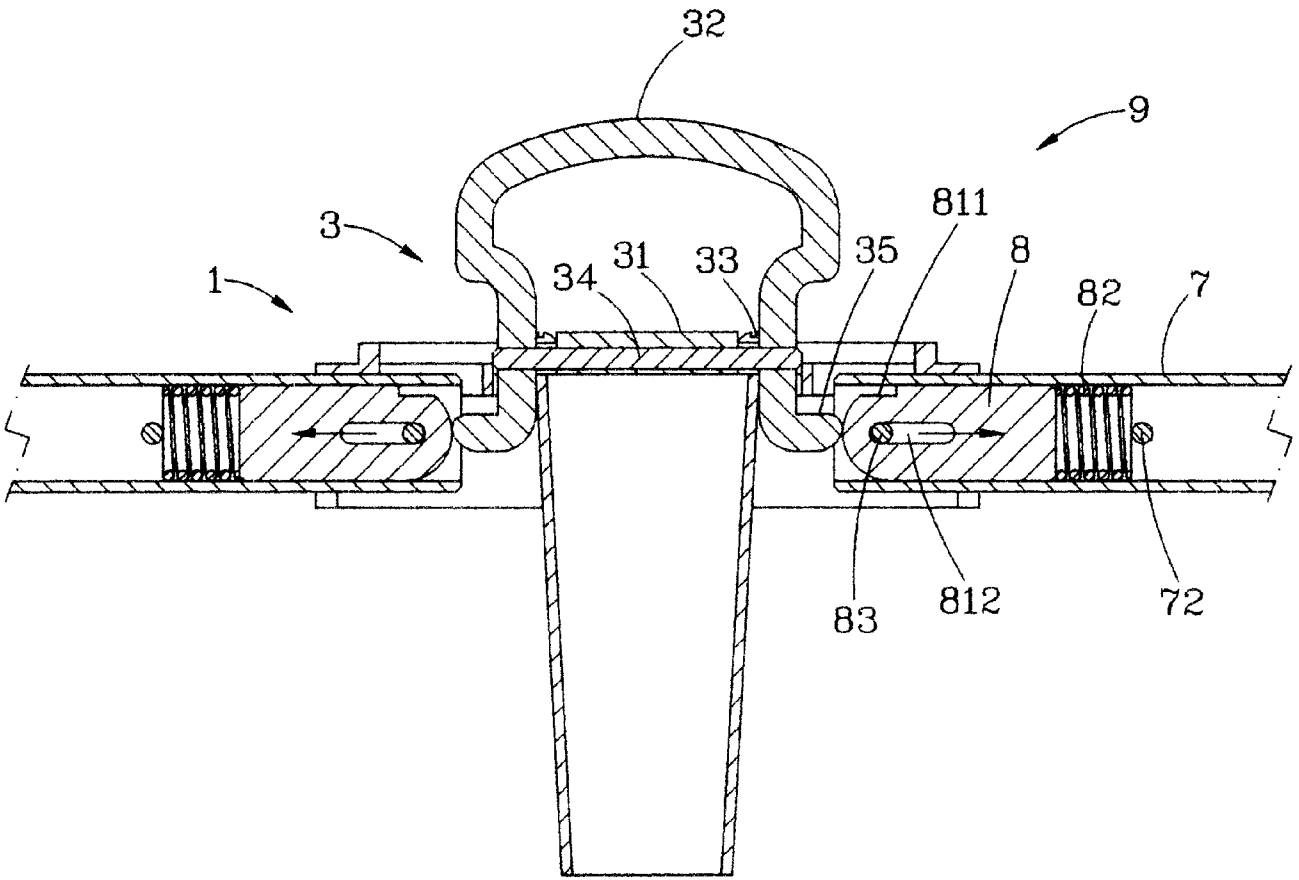
FIG. 4 is a sectional view showing the present invention in motion.
Figure 5:
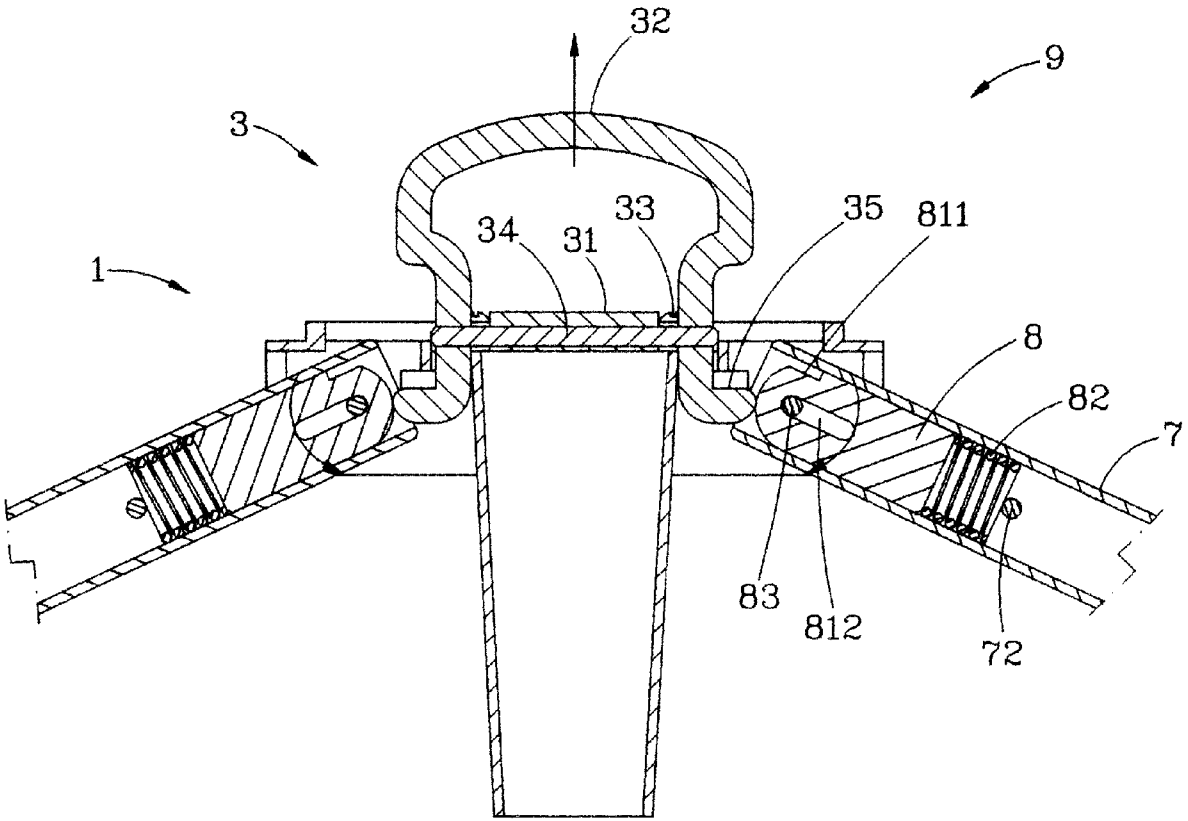
FIG. 5 is another sectional view showing the present invention in motion.

As shown by FIG. 4, to fold the game-bed, push the handle 32 of releasing device 3 upward, then move both swaying objects 35 downward into both concave chutes 12,12 of main unit 1 until the swaying objects touch the flat area 811 and force all bars 8 to recoil inside second cylinder 7. After the unlocking procedure is completed, users may lift up the main unit 1. As users lift up the main unit 1, the angle between main unit 1 and second cylinder 7 decreases (as shown by FIG. 5). Then, users may fold the game-bed.

As stated in preceding motion, users need to unlock the device before they can fold the game-bed. The present invention will reduce danger significantly if kids carelessly fold the game-bed.

Based on the preceding statement, the double locks for the chassis of game-bed is obviously an invention of breakthrough, and is a practical and safe device. The present invention has never been publicized/disclosed in any documents, nor distributed in the domestic/overseas market before. The present invention is, therefore, industrially valuable.

Having thus described the invention, what the inventor claims as new and desire to be secured by the United States Patent and Trademark Office include:

1. A double lock device for a frame of a playpen comprising:

a main unit with a releasing device on a top side thereof, a releasing device comprising a base, a release handle, and an axle to pivotally attach said release handle to said base, and four frame legs pivotally attached to said main unit, said frame legs being normally locked in a deployed position; wherein a spring loaded retractable bar is inserted into inner ends of each of two opposing frame legs, said retractable bars being urged by a spring means toward an extended position when said frame legs are deployed; such that when a user lifts said release handle, projecting tabs on ends of said release handle contact flat areas of said retractable bars so as to apply outward pressure, thereby forcing said retractable bars into said opposing frame legs such that said locking device is released, and all said frame legs can be collapsed for storage.

2. The double lock device as defined in claim 1 wherein:

two concave depressions are included on said top side of said main unit, said concave depressions corresponding in shape and location to said projecting tabs on said ends of said release handle.

3. The double lock device as defined in claim 1 wherein:

said main unit comprises four openings to receive said frame legs, said openings each having an open lower side to accommodate pivoting of said frame legs.

4. The double lock device as defined in claim 3 wherein:

each said opening comprises a blocking object on a lower portion thereof to hold said frame legs in said deployed position.

5. The double lock device as defined in claim 1 wherein:

a pivot axle of each of said two opposing frame legs passes through both said retractable bar and said frame leg.

6. The double lock device as defined in claim 5 wherein:

each said opening comprises a blocking object on a lower portion thereof to hold said frame legs in said deployed position.

* * * * *